United States Patent [19]

Kitamura

[11] 4,366,670

[45] Jan. 4, 1983

[54] VACUUM CONTROL VALVE FOR EXHAUST GAS CLEANING SYSTEM

[75] Inventor: Kazuhiko Kitamura, Toyota, Japan

[73] Assignee: Aisin Seiki Kabushiki Kaisha, Kariya, Japan

[21] Appl. No.: 208,263

[22] Filed: Nov. 19, 1980

[30] Foreign Application Priority Data

Dec. 5, 1979 [JP] Japan ..... 54-157757

[51] Int. Cl.[3] ..... F01N 3/22

[52] U.S. Cl. ..... 60/290; 123/587; 137/85

[58] Field of Search ..... 60/289, 290; 123/327, 123/407, 571, 568, 587; 137/85, DIG. 8

[56] References Cited

U.S. PATENT DOCUMENTS

| | | | |
|---|---|---|---|
| 2,848,202 | 8/1958 | Leibing | 137/85 |
| 3,587,617 | 6/1971 | Olsen | 137/85 |
| 3,675,633 | 7/1972 | Nakajima | 123/568 |
| 4,033,125 | 7/1977 | Inada | 60/290 |
| 4,052,996 | 10/1977 | Burrus | 137/85 |
| 4,100,735 | 7/1978 | Miyagi | 60/290 |
| 4,146,986 | 4/1979 | Kohama | 60/290 |
| 4,166,476 | 9/1979 | Yamanaka | 60/290 |
| 4,297,984 | 11/1981 | Kawabata | 123/587 |
| 4,316,479 | 2/1982 | Franz | 137/85 |

*Primary Examiner*—Douglas Hart

*Attorney, Agent, or Firm*—Oblon, Fisher, Spivak, McClelland & Maier

[57] ABSTRACT

In an exhaust gas cleaning system for an internal combustion engine in which additional air is injected from outside into an engine exhaust manifold by an on-off-duty solenoid valve under control of a microcomputer operating on the partial oxygen pressure in the exhaust gas as detected by an oxygen sensing element, the engine r.p.m. and the exhaust gas temperature, a vacuum control valve adapted to add vacuum signals responsive to variations in the intake manifold vacuum of the engine and throttle opening to the output vacuum signals of the solenoid valve commanding the air injection.

3 Claims, 1 Drawing Figure

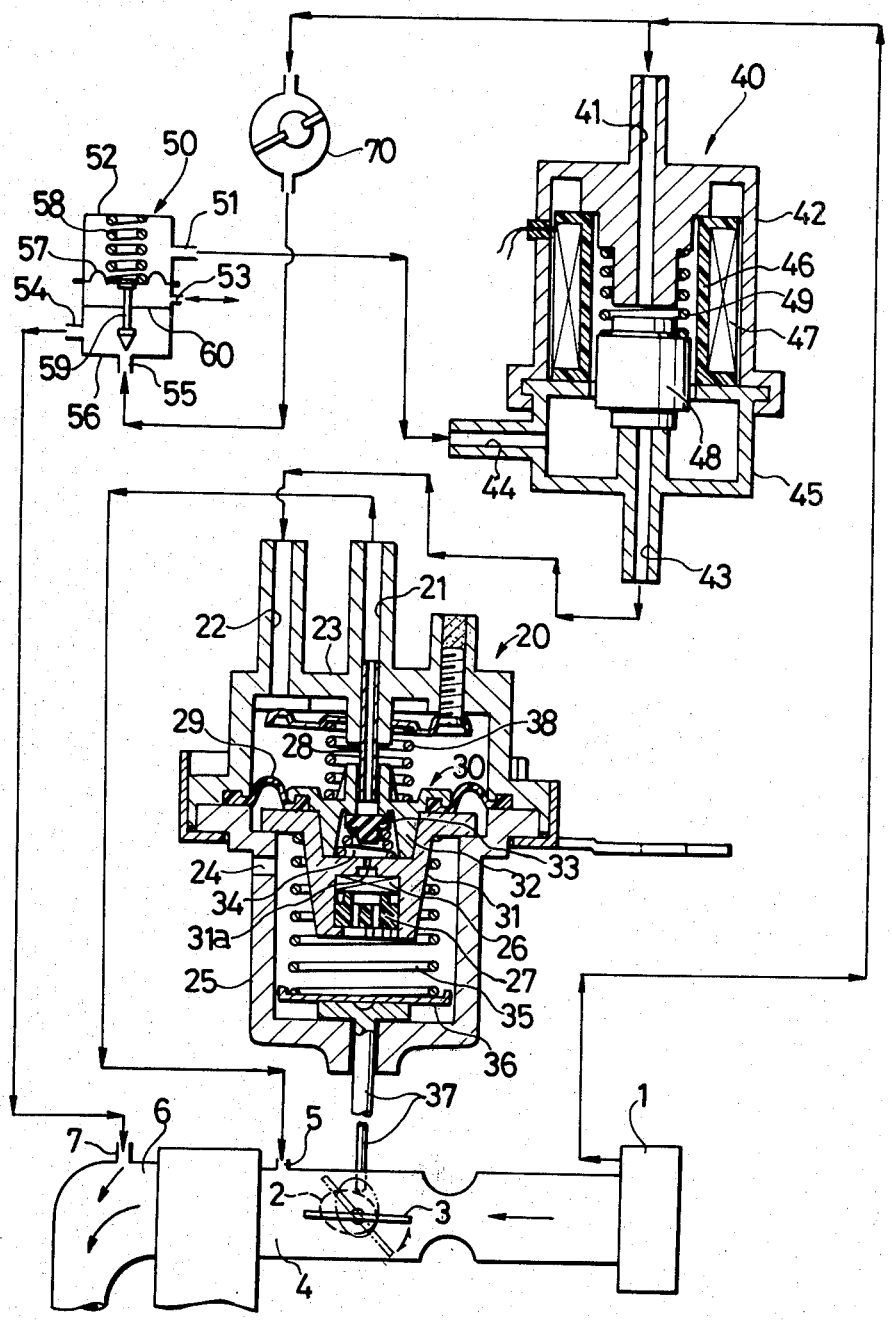
40
41
42
46
49
47
48
45
44
43
70
50
52
51
58
57
53
54
60
59
55
56
21
22
23
20
29
28
38
30
33
24
34
32
31
31a
26
25
27
35
36
37
1
6
7
5
2
3
4

VACUUM CONTROL VALVE FOR EXHAUST GAS CLEANING SYSTEM

BACKGROUND OF THE INVENTION

1. Field of the Invention

This invention relates to a system for adding a controlled amount of air to exhaust gases in the exhaust manifold of an internal combustion engine downstream of the combustion chamber for the purpose of cleaning the exhaust gases.

2. Description of the Prior Art

In this type of exhaust cleaning system, the flow rate of additional air to be fed to the engine exhaust manifold from an air pump is controlled by a flow control valve in response to vacuum signals from an on-off solenoid valve which is under on-off duty control of a microcomputer operating on the input signals indicative of variations in the partial oxygen pressure in the exhaust gases as detected by an oxygen sensing element, the engine r.p.m., the exhaust gas temperature, the throttle opening of the carburetor and the intake manifold vacuum. The cleaning system normally employs a vacuum control valve for providing a vacuum source of a predetermined level by controlling the vacuum which is drawn from the engine intake manifold. The controlled vacuum is fed to the on-off-duty solenoid valve thereby producing vacuum signals to operate the flow control valve. Namely, the feed rate of the addition air to the engine exhaust gases is solely controlled by the on-off-duty solenoid valve operating in response to command signals from a microcomputer which processes various operational variables according to predetermined arithmetic formulas. In this connection, recently there is an increasing trend toward a greater reliance on the control and arithmetic operations by the microcomputer. Therefore, it is desirable to lessen the burden which is imposed on the microcomputer for the control and arithmetic operations, even in a sophisticated control system.

Further, in the conventional control method employing a vacuum control valve which produced output vacuum of a constant level, the vacuum control in response to the engine load has been effected solely through the control of the air bleed amount by the on-off solenoid valve, thus involving problems concerning large air consumption and vacuum losses.

SUMMARY OF THE INVENTION

The present invention has as its primary object the provision of a vacuum control valve for an exhaust gas cleaning system of the sort mentioned hereinbefore, the vacuum control valve producing vacuum signals proportional to operational variables such as the engine load or the engine intake manifold vacuum and the carburetor throttle opening to thereby control the feed rate of additional air.

It is another object of the present invention to provide an exhaust gas cleaning system of the sort mentioned above, in which the vacuum generator serves as a vacuum source for the solenoid valve under on-off-duty control, and at the same time lessens the burden of the microcomputer by adding to the output vacuum signals of the solenoid valve vacuum signals responsive to the intake manifold vacuum and the throttle opening.

It is a further object of the present invention to optimize the feed of additional air in an exhaust gas cleaning system of an internal conbustion engine, thereby saving power consumption.

According to the present invention, there is provided a vacuum control valve for use in an exhaust gas cleaning system of an internal combustion engine, the vacuum control valve including a casing, a diaphragm dividing the casing into a first chamber communicating with the engine intake manifold and a second chamber communicating with atmosphere, a valve member fixed in a center portion of the diaphragm, first and second spring means provided respectively in the first and second chambers and arranged to opposingly act on the diaphragm; a movable valve body provided within the valve member to normally close a valve port between the first and second chambers under biasing force of a spring and adapted to communicate the first and second chambers with each other when the diaphragm is displaced by a predetermined distance by an increase in vacuum in the first chamber; and an output port for transfer of vacuum signals from the first chamber; producing at the output port on-off vacuum signals in proportion to the engine load.

The above and other objects, features and advantages of the invention will become apparent from the following description and the appended claims, taken in conjunction with the accompanying drawing which shows a preferred embodiment of the present invention.

BRIEF DESCRIPTION OF THE DRAWING

In the accompanying drawing, the sole FIGURE is a schematic diagram of an exhaust gas cleaning system for an internal combustion engine according to the present invention.

DETAILED DESCRIPTION OF THE PREFERRED EMBODIMENT

Referring to the drawing, there is shown an internal combustion engine having an intake manifold 4 and an exhaust manifold 6. The intake manifold 4 is provided with an air cleaner 1 and a throttle valve 3 of a carburetor. Indicated at reference number 2 is a cam which is mounted on the axis of the throttle valve 3, at 5 is a port for drawing out the intake manifold vacuum, and at 7 is a port for injecting additional air into the exhaust gases in the exhaust manifold. Reference number 20 denotes a vacuum control valve of the present invention employed for an exhaust cleaning system which includes, as in the conventional counterparts, an on-off solenoid valve 40, a flow control valve 50 and an air pump 70 of known construction and arrangement. The arrows serve to indicate the air flow directions.

The vacuum control valve 20 has a first casing 23 with a port 21 communicating with a vacuum source and an output port 22, and a second casing 25 with a port 24 communicating with the atmosphere. One end of a pipe 28 is fixedly fitted into the vacuum port 21. A diaphragm 29 which has its peripheral edges fixed between the first and second casings 23 and 25 separates the inner chambers of the first and second casings from each other. Secured to the center portion of the diaphragm 29 is a valve assembly 30 which, in this particular embodiment, includes a valve seat 31, a valve cover 32, a movable valve body 33, a coil spring 34, a filter 26 and a filter holder 27. The valve cover 32 is pressed into the valve seat 31, joining the valve seat 31 and diaphragm 29 integrally with each other. The movable valve body 33 is urged upwardly by the biasing force of the compression spring 34 within the space which is surrounded by the valve seat 31 and cover 32.

The cover 32 is provided with a center hole for receiving the lower end portion of the pipe 28. The inner diameter of the center hole is slightly greater than the outer diameter of the pipe 28, so that the movable valve body 33 abuts against the pipe 28 when the diaphragm 29 and valve assembly 30 are displaced upwardly against the biasing force of a compression spring 38 constituting the first spring means. As the valve assembly 30 is further displaced upwardly, the inner space of the valve assembly 30 communicates with the inner space of the first casing 23. Simultaneously, the inner space of the valve assembly 30 is blocked against communication with the port 21 to the vacuum source.

In the drawing, the vacuum port 21 is in communication with the inner space of the first casing 23 through the space between the valve assembly 30 and pipe 28. The valve seat 31 is provided with a narrow passage 31*a* in communication with the inner space thereof which in turn communicates with an atmospheric port 24 through the filter 26, holder 27 and the inner space of the second casing 25, drawing air into the inner space defined by the valve seal 31 and valve cover 32.

The lower end of a coil spring 35 which mounted in the second casing 25 to serve as a second spring means rests on a seat plate 36 which is supported on a head portion of a support member 37. The support member 37 has its leg portion extended out through a hole at the center of the bottom wall of the second casing 25.

In the preferred embodiment shown, an eccentric cam member 2 is securely mounted on the rotational axis of the throttle valve 3 to lift the leg portion of the support 37 with its cam face according to the position of the throttle valve 3. When the throttle valve 3 is in the position shown by two-dot chain line, the cam 2 is at its upper dead center position, holding the support member 37 in the uppermost position. The displacement of the support member 37 into and out of the second casing can be adjusted as described by suitably contouring the face of the cam member 2. If desired, the cam member 2 may be substituted by other link or lever means which are arranged to drive the support member 37.

The vacuum control valve 20 operates in the following manner. If the support member 37 is stopped in the lowermost position indicated in solid line, the lower end of the coil spring 35 remains in the position shown. Since the pressure existing in the inner chamber of the first casing 23 is the same pressure existing in the intake manifold 4 as the vacuum port 21 is in communication with the inner chamber of the first casing 23 through the pipe 28, a hole in the valve cover 32 and gap around the outer periphery of the pipe 28 and the inner chamber of the second casing 25 associating with the diaphragm 29 is at atmospheric pressure, the diaphragm 29 and valve assembly 30 are pushed upwardly against the force of the spring 38, contracting the inner space of the first casing 23. As a result, the lower end of the pipe 28 is thrust into the valve assembly 30 and into abutting engagement with the upper face of the movable valve body 33, whereupon the movable valve body 33 is pushed downwardly within the valve assembly 30 against the force of the spring 34 to communicate the inner space of the valve assembly 30 with the inner space of the first casing 23. Consequently, air is drawn into the inner chamber of the first casing 23 through the narrow passage 31*a* and the inner space of the valve assembly 30, thereby increasing the pressure (or lowering the vacuum) in the inner chamber of the first casing 23 and driving the valve assembly 30 downward by the force of the spring 38. This causes the pipe 28 to shift out of the inner space of the valve assembly 30 to close the same with the movable valve body 33 as shown in the drawing, whereupon the pressure in the inner chamber of the first casing 23 is lowered (i.e. to a higher vacuum), driving the valve assembly 30 upward. In this manner, the downward and upward displacements of the valve assembly 30 are repeated to maintain the pressure in the inner chamber of the first casing 23 at a constant level in terms of time sequence, which is determined by the biasing forces of springs 38 and 35.

If the support member 37 is pushed upward, coil spring 35 is compressed, imposing a greater upward force on the valve assembly 30 than in the position shown in the drawing, elongating the time period to close the vacuum port 21 by the movable valve body 33 and communicating the inner spaces of the first casing 23 and the valve member 30 with each other, so as to lower the vacuum in the inner chamber of the first valve body 23. Thus, the higher the support member 37 is pushed, the lower the vacuum becomes in the inner chamber of the first casing 23. Namely, the vacuum in the inner chamber of the first casing 23 varies commensurately with the displacement of the support member 37. In the sole FIGURE, since the support member 37 is urged outwardly by the coil spring 35, it is held in the uppermost position by the cam member 2 when the throttle valve 3 is closed (indicated by two-dot chain line) but is lowered along with the receding cam face as the throttle valve 3 is opened, increasing the vacuum in the first casing 23. In this manner, the vacuum in the inner chamber of the first casing 23 is varied according to the throttle position and the cam shape and the resulting output vacuum is applied to a vacuum port 43 of an on-off solenoid valve 40.

The on-off solenoid valve 40 includes a first casing 42 of a magnetic material having an air inlet port 41, a second casing 45 of a magnetic material having a vacuum inlet port 43 and an output port 44, a coil bobbin 46, a coil 47, a plunger 48 of a magnetic material, and a compression coil spring 49. When the coil 47 is in a deenergized state, the plunger 48 is pushed downwardly by the force of the spring 49 as shown in the drawing, closing the vacuum inlet port 43 and communicating the air inlet port 41 with the inner chamber of the second casing 45.

Upon energizing the coil 47, the plunger 48 is attracted inwardly of the bobbin 46 against the force of spring 49, the plunger closing the air inlet port 41 while uncovering the vacuum inlet port 43 for communication with the inner chamber of the second casing 45, since the inner diameter of the bobbin 46 is greater than the outer diameter of the plunger 48. Thus, the output vacuum of the vacuum control valve 20 is applied to the inner chamber of the second casing 45 when the coil 47 is in an energized state. On the other hand, when the coil 47 is in a deenergized state, atmospheric pressure is applied to the inner chamber of the second casing 45. In this instance, if the coil 47 is energized by pulsewise currents to control its output, a pressure (vacuum) corresponding to the same prevails in the inner chamber of the second casing 45. By this control which is conventionally known, the vacuum in the inner chamber of the second casing 45 is controlled in the known manner according to the variables of the engine operating conditions other than the engine load (throttle position).

The pressure in the inner chamber of the second casing 45 is applied to a control port 51 of a flow control valve 50 through the output port 44.

The flow control valve 50, which is of known construction, is constituted by a first casing 52 having a control port 51, a second casing 56 having an atmospheric port 53, an output port 54 and an air inlet port 55, a diaphragm 57 partitioning the inner spaces of the first and second casings 52 and 56 from each other, a compression coil spring 58 urging the diaphragm 57 toward the second casing 56, a valve body 59 having one end thereof secured to the diaphragm 57 and the other end disposed opposingly to the air inlet port 55, and a partition wall 60 dividing the inner space of the second casing 56 between the atmospheric port 53 and the output port 54. With this flow control valve 50, as the vacuum at the control port 51 is increased, the diaphragm 57 is pulled inwardly of the first casing 52 against the force of the spring 58, increasing the flow rate of air from the air inlet port 55 to the output port 54. On the contrary, if the vacuum at the control port 51 is lowered, the diaphragm 57 is displaced inwardly of the second casing 56 by the force of the spring 58 to reduce the flow rate of air from the air inlet port 55 to the output port 54. The air inlet port 55 is supplied with air from an air pump 70, and air which flows out through the output port 54 is injected into the exhaust manifold 6.

As clear from the foregoing description, in the vacuum control valve according to the present invention, the force of the spring acting on the diaphragm which partitions the vacuum and atmospheric chambers is varied by the displacement of the support member which supports one end of the spring, thereby controlling the output vacuum according to the mechanical displacement of the throttle valve or the like which is responsive to the engine load condition. Therefore, the on-off solenoid valve suffices to control the duty in a narrower range according to variables of the engine operating conditions other than the engine load, and it becomes possible to lessen air bleeding.

On-off-duty control of the solenoid valve as discussed above occurs due to operation of a control system of a quantity of air flow flowing through the solenoid valve by changing the duty of time to energize the solenoid (time period of number of pulses of electric current for energizing the solenoid).

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A vacuum control valve device for an exhaust gas cleaning system of an internal combustion engine, said valve device comprising:

a casing;

a diaphram dividing the interior of said casing into a first chamber communicating with the intake manifold of said engine and a second chamber communicating with the atmosphere;

a valve member fixed in the center portion of said diaphragm;

first spring means mounted in said first chamber between said valve member and said casing and acting on said valve member in a direction of expanding said first chamber;

second spring means provided in said second chamber between said valve member and a support member acting on said valve member opposingly to said first spring means in a direction of contracting said first chamber;

said support member being displaceable for varying the biasing force of said second spring means in response to the displacement of the accelerator pedal;

a movable valve body provided within said valve member and a spring normally urging said movable valve body to block communication between said first and second chambers, said valve body allowing communication between said first and second chambers when said diaphragm is displaced by a predetermined distance due to an increase of the vacuum prevailing in said first chamber; and output port means for transferring vacuum signals from said first chamber;

said first chamber being intermittently communicated with the intake manifold of the engine to produce at said output port on-off vacuum signals having an amplitude proportional to the intake manifold vacuum.

2. A vacuum control valve device as set forth in claim 1, wherein said casing consists of first and second casings, said first casing having a passage communicating with said first chamber and said second casing having a passage communicating with said second chamber; said movable valve body being mounted in a chamber formed in said valve casing and urged by said spring to normally close the passage communicating with said first chamber in one of said valve casings; a stopper positioned in said first chamber for pushing said movable valve body to establish communication between said first and second chambers; said stopper contacting said movable valve body of said valve device to communicate said first chamber with atmosphere when said diaphragm is displaced by the vacuum of said first chamber in a direction of reducing the volume of said first chamber, thereby producing on-off vacuum signals at said output port means.

3. A vacuum control valve device as set forth in claim 1, further comprising a carburetor, a cam fixedly mounted on the axes of the carburetor, a plate for supporting the spring in said second chamber and a rod positioned so as to slidably pass through the casing of the device and having one end thereof secured to said plate and an opposite end engaged with said cam, said rod being slidable in proportion to the carburetor opening relative to said casing of the device to compress said first spring means through said second spring means, thereby adding vacuum proportional to the carburetor throttle opening to on-off vacuum signals produced at said output port means.

* * * * *